United States Patent [19]

Bell et al.

[11] 4,240,593

[45] Dec. 23, 1980

[54] REEL HAVING HONEYCOMB CORE

[75] Inventors: Harris N. Bell; Alexander R. Morton, both of High Point, N.C.

[73] Assignee: Jiffy Manufacturing Company, Inc., Hillside, N.J.

[21] Appl. No.: 90,881

[22] Filed: Nov. 5, 1979

[51] Int. Cl.[3] ..... B65H 75/18

[52] U.S. Cl. ..... 242/71.8; 242/68.5

[58] Field of Search ..... 242/71.8, 68.5, 68.6, 242/118, 118.1, 118.11, 118.31, 118.4, 118.7, 118.8; 428/73, 12, 118

[56] References Cited

U.S. PATENT DOCUMENTS

| | | | |
|---|---|---|---|
| 2,854,199 | 9/1958 | Boyer | 242/71.8 |
| 3,093,343 | 6/1963 | Welshenbach | 242/118.8 |
| 3,266,749 | 8/1966 | Christain | 242/118.7 |
| 3,960,341 | 6/1976 | Theien | 242/118.1 |

*Primary Examiner*—Edward J. McCarthy
*Attorney, Agent, or Firm*—David Rabin

[57] ABSTRACT

A reel for supporting windings of cable, cord, ribbon, thread or the like in which the supporting core is fabricated from a honeycomb structure of expanded piles of sheet material to which core a flange is concentrically secured. The honeycomb core may have either axially-extending cells with radially projecting ribs or radially-extending cells and radially-extending side ribs secured to a concentric flange.

10 Claims, 7 Drawing Figures

REEL HAVING HONEYCOMB CORE

BACKGROUND OF THE INVENTION

Reels for supporting cable, cord, thread, ribbon, thread and wire materials have been utilized in many arts and have been fabricated of metal, cardboard, plywood or plastic. More recently, the cylindrical core on which the materials of the reel are supported have been fabricated of plastic materials including polyurethane or other plastic materials. The cost of the plastic components has been steadily increasing on account of the ever-increasing cost of petroleum products from which the plastics are derived. Additionally, the weight of the reel when fabricated of dense materials adds to the cost of shipping the materials on the reel.

Usually the reels are damaged in shipment or use, and they are either discarded or the repairs are costly for recycling damaged reels.

It is vital to have the reels maintain their structural integrity throughout their useful life while providing an economical product that is not prohibitive in cost relative to the materials that will be wound on the reels.

OBJECTIVES AND ADVANTAGES OF THE INVENTION

Honeycomb structures utilizing sheets or plies of stacked flat material and bonding agents at predetermined positions to form a laminated stock which when expanded will form open honeycomb configurations that define geometric cell openings are generally well known by a number of techniques illustrative of which is shown in U.S. Pat. Nos. 1,924,472; 2,428,979; 2,610,934; 2,636,540; 2,731,379; 2,734,843; 3,227,599, among others. However, the utilization of the structural integrity and economy of a honeycomb cylindrical core for a reel has been determined to be highly advantageous. The light weight of th core and its structural integrity, properly assembled, permits ease of manufacture of a sturdy and economical reel which may be made entirely of flexible paper or cellulose products eliminating more costly materials.

Accordingly, it is an objective of this invention to provide a lightweight, sturdy and economical flanged reel having a honeycomb core on which cable, wire, cord, ribbon and other materials may be wound, stored, shipped and used.

Another objective of this invention is the provision of a flanged reel having a honeycomb material supporting core in which the core may be fabricated of paper plies and the flanges supported on the sides of the core may be fabricated of corrugated paperboard.

Yet another objective of this invention is the provision of a flanged reel in which a honeycomb structure forms the core and a flexible sheet retained on the core to provide a smooth supporting surface for the material to be supported on the core between side flanges.

Still a further objective of this invention is to provide a flanged reel having a honeycomb core that is simple to fabricate, inexpensive to make, and sufficiently low in cost to be disposable when damaged in shipment or use.

Other objectives and many of the attendant advantages of this novel flanged reel having a honeycomb core will become more readily apparent to those skilled in the art upon consideration of the detailed description of the invention in which a preferred embodiment is described in greater detail and from the appended claims in which modifications and equivalents are contemplated, and from the drawing in which a brief description is set forth illustrating various embodiments of the invention.

DETAILED DESCRIPTION OF PREFERRED AND ALTERNATE EMBODIMENTS

Figure 1:
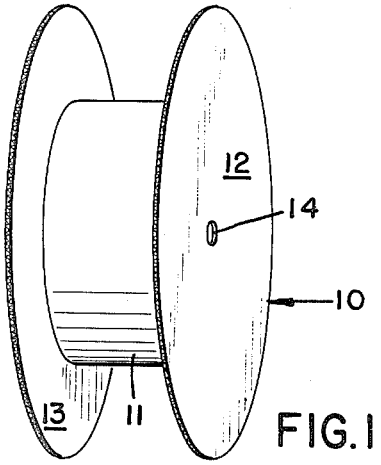
FIG. 1 is a perspective view of a flanged reel having a honeycomb core embodying this invention.
Figure 2:
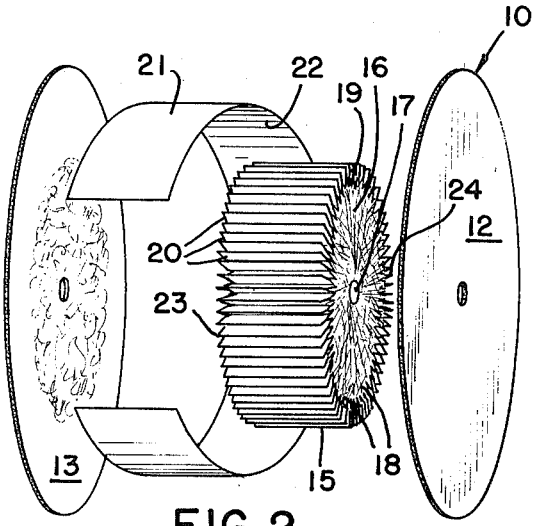
FIG. 2 is an exploded perspective view of the flanged reel of FIG. 1 illustrating the various components in the preferred embodiment including the cylindrical core of honeycomb structure with radially-extending ribs and transversely extending honeycomb openings with spaced side flanges and a flexible covering for the cylindrical core on which the material on the reel may be wound and supported.

Referrng now to the drawing, wherein like reference characters designate like or corresponding parts throughout the several views, there is shown in FIGS. 1 and 2 a flanged reel 10, the prefered embodiment, in which the spool or barrel 11 on which the material to be wound and stored is cylindrical in shape has a pair of concentric, circular flanges 12 and 13 at each end of th spool 11 with an axial or central opening 14 through the reel for supporting it for storage or rotation on a suitable shaft (not shown).

Preferably, each of the flanges 12 and 13 is fabricated of one or more substantially rigid sheets of corrugated board with each flange corrugated board having flat paper surfaces secured to the corrugated lining. The stiffness and thickness, as well as the number of corrugated plies may vary for each flange depending upon the ultimate end use for the particular reel. However, the diameter of the flanges 12 and 13 will preferably be greater than the diameter of the spool 11.

The spool or reel core 15, as shown in FIG. 2, is cylindrical in cross-section transverse to the core axis with the core being fabricated from a multiplicity of sheets of flexible material, preferably paper, laminated and secured together to form a honeycomb structure 16 having an axial opening 17 with the individual cells 18 extending axially throughout the core 15. The outer periphery 19 of the core 15 is provided with circumferentially-spaced, axially-extending, and radially-projecting ribs 20 which ribs are formed upon rotation of the stacked secured plies of sheet material to be described hereafter.

The core 15 is covered by a flexible sheet 21, preferably of flat paper stock material, which may also be of corrugated board depending upon the end use of the reel and the requisite strength characteristics necessary depending upon the material to be supported on the reel core 15. The flexible sheet material 21 is preferably secured to the periphery 19 of the core 15 by a suitable adhesive bonding the inside surface 22 of the sheet material 21 to the radially-projecting ribs 20 of the core 15. The necessary bonding may be achieved by utilization of an appropriate adhesive sprayed on the ribs 20 and on the under-surface 22 of the sheet 21 before wrapping the sheet 21 about the core 15.

The sides 23 and 24 of the core 15 may be sprayed or dipped with a suitable adhesive before applying the flanges 12 and 13 to each side. Suitable pressure is applied to the flanges 12 and 13 whether by stacking additional assembled units, one on top of the other, or by other appropriate means, for a suitable period of time to permit the adhesive to set forming a substantially unitary structure that is substantially rigid.

The cylindrical core member 15 has a geometric configuration that is substantially a right cylinder in which the sides 23 and 24 are substantially parallel to each other and at a right angle to the core axis. Where increased flange rigidity is required, added plies of corrugated board may be adhered together to the flanges 12 and 13 or other flange material may be substituted.

Figure 7:
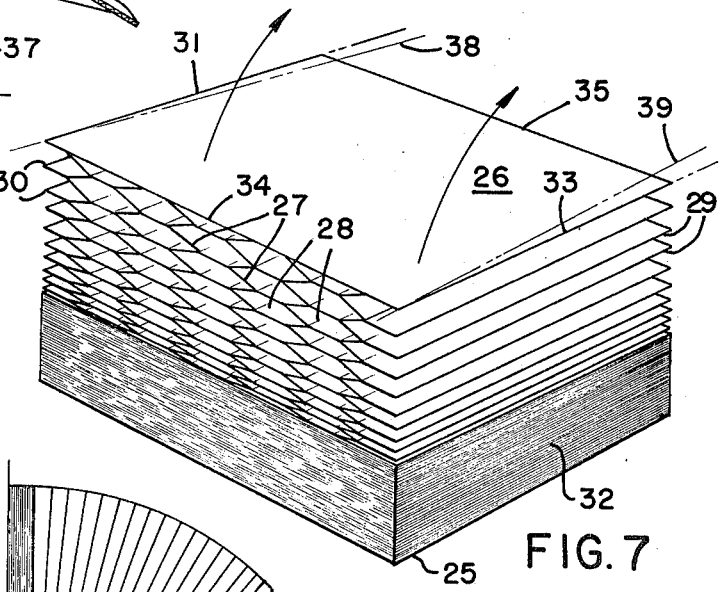
FIG. 7 is a perspective view of a stacked honeycomb pack with the upper portion extended and the lower portion collapsed illustrating rotary displacement of the interconnected plies to form radially-extending rib sides and cells, and broken lines to indicate compensation for dimensional decrease in the outer portion relative to the center portion.
Figure 6:
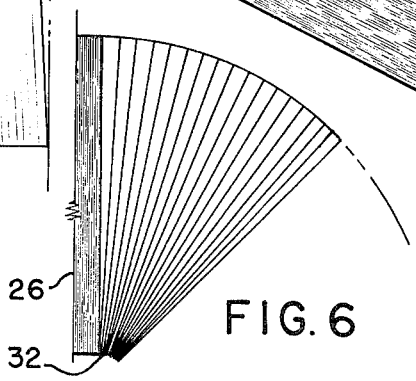
FIG. 6 is a reduced and partial left end view of FIG. 5 illustrating the rotation in accordion-like manner of spreading of the interconnected plies to form an arcuate configuration preliminary to the formation of a cylindrical core for the reel.

There is illustrated in FIG. 7 a block 25 consisting of a plurality of layers or plies of flexible sheet material 26 that are adhesively secured at spaced intervals selectively in the stack of sheets ultimately to yield the honeycomb configuration 27 with the hexagonal configuration for the individual cells 28 in the upper portion of the block 25 that has been raised vertically in accordian-like manner to expand relative to the lower compact portion of the block 25 that remains in a compressed condition. The projecting ribs 29 and 30 which extend on opposite sides of th block 25 are the same as the ribs 20 in FIG. 2, and the cells 28 are similar to the axially-extending cells in the core 15. In order to achieve the configuration of the core 15 shown in FIG. 2, the block 25 with the stacked plies 26 will be extended from the edge 31 to rotate or pivot about the shorter length 32 of th block 25, substantially as shown in FIG. 6 to fan out until a cylindrical configuration is formed comparable to that illustrated in FIG. 2 for core 15. In this configuration, the width of the edge 31 will be the same as the width of the edge 33 forming a uniform right angle cylinder geometric configuration as in FIG. 2.

However, in an alternate configuration, by having the block 25 with the upper plies 26 rotated or pivoted in a clockwise direction with the edge 34 forming the outer periphery along with the adjacent plies, and the cells 28 extending radially, as opposed to extending axially, the width of the edge 34, and its corresponding additional plies in the block 25, will become foreshortened relative to the edge 35 which will form, with adjacent plies, the axial opening in the cylindrical core with the edge 35 and its plies being wider linearly than the more distant edges 34 and the corresponding plies distant from the axial core. By attempting to form a cylinrical core in this latter configuration, the ultimate configuration of the core will assume an outwardly converging configuration as illustrated more clearly in FIG. 5 in which the outer extremities will be foreshortened as indicated at 36 and 37 relative to the edge 35 at the inner axial core represented by the edge 35 in FIG. 5.

Figure 5:
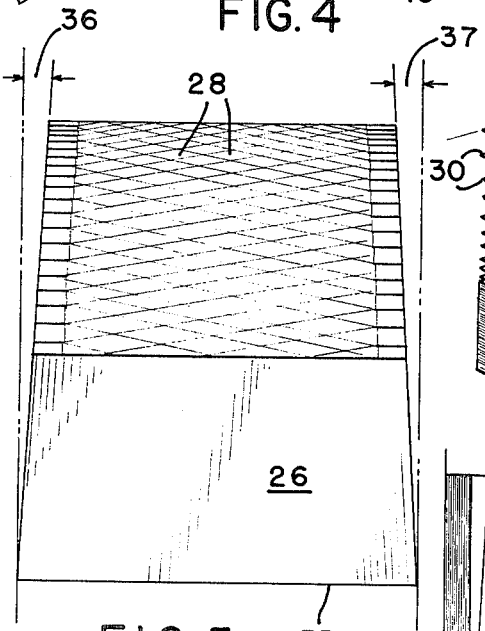
FIG. 5 is a schematic illustration of a partially expanded honeycomb pack for forming the cylindrical core with the cells extending radially and illustrating the transverse dimensional decrease between the lower and the upper sections.

Difficulty is encountered in applying flanges in the configuration shown in FIG. 5 since the flanges would be conically dished inwardly due to the contraction caused by the expanding cells.

In order to overcome this problem, blocks 25 may be cut or severed along the broken lines 38 and 39. This will compensate for the convergence illustrated in FIG. 5 at 36 and 37 thereby permitting the formation of a right angle cylindrical core with the honeycomb cells 28 extending radially and the ribs 29 also extending radially substantially from the axis outwardly against which ribs 29 and 30 flanges 12 and 13 may be adhered with the flexible sheet 21 enveloping the radially extending honeycomb cells 28 to form a suitable reel having the honeycomb structure for the core resulting in a reel as shown in FIG. 1.

Figure 3:
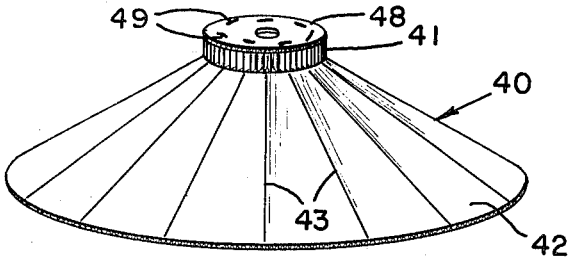
FIG. 3 is a perspective view of an alternate form of a reel having a single flared flange depending from a honeycomb core.
Figure 4:
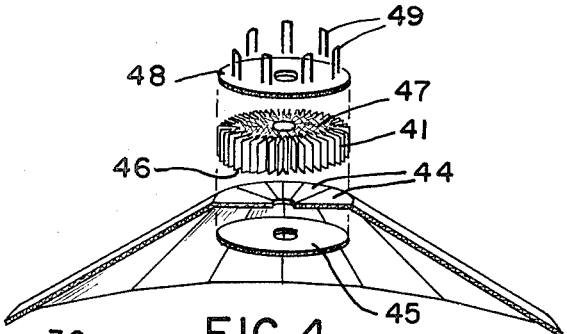
FIG. 4 is an exploded and partial transverse sectional view of the alternate form of flanged reel shown in FIG. 3.

An alternate embodient of a flanged reel 40 is shown in FIGS. 3 and 4 in which the reel or spool core 41 is substantially of the construction described heretofore for the reel core 15 in FIG. 2 except that it may be substantially smaller in diameter and axial length depending upon the end use. The substantially frusto-conical flange 42, which may be of corrugated board having suitable radiating score lines 43, is provided with inwardly-projecting tabs 44 that will cooperate with the corrugated circular disc 45 positioned beneath the tabs 44, as shown in FIG. 4, to engage them and retain them against the bottom surface 46 of the reel core 41 with the top portion 47 cooperatively receiving the circular corrugated disc 48 into which the U-shaped fastening staples 49 are driven to secure the disc 45, the tabs 44, the reel core 41 and the disc 48 together after the U-shaped staples are clinched or upset after piercing through the disc 45 to form the reel 40 as shown in FIG. 3. If desirable, a flexible band (not shown) may encircle the periphery of the reel 41.

Various modifications may be made with respect to the diameter and the longitudinal extend of the reel core including differences in materials although flat sheet paper stock is desirable for the honeycomb structure of the reel core.

Modifications of the flanges and the means of adhering the various components together in place of adhesives are contemplated within the scope of the appended claims. It has been found desirable to dip the reel core ends in an adhesive bath and then apply the flanges to said core ends, and then stacking the reels one on another by aligning the core axes vertically.

We claim:

1. A reel for supporting windings of cable, wire, cord, threads, ribbons or the like comprising; a cylindrical honeycomb core having a plurality of selectively laminated sheets of flexible material, and a flange concentric with said core secured to said core.

2. A reel as claimed in claim 1, said core having opposite sides each side having a flange concentrically secured to the sides of said core.

3. A reel as claimed in claim 1, and a flexible sheet of flat material encircling said core and secured thereto.

4. A reel as claimed in claim 1, said honeycomb core having a periphery including circumferentially-spaced and longitudinally-entending ribs and axially-extending cells.

5. A reel as claimed in claim 1, said honeycomb core having a periphery including a multiplicity of radially-extending cells, and core sides each having radially extending ribs, and flanges concentric with said core secured to said ribs on each side of said core.

6. A reel as claimed in claim 1, said honeycomb core flexible sheets being of flat paper.

7. A reel as claimed in claim 1, said flange being of corrugated paperboard material.

8. A reel as claimed in claim 1, said flange having a frusto-conical configuration.

9. A reel as claimed in claim 4, said honeycomb core flexible sheets being of paper material, said core having sides, flanges concentric with said core secured to said core sides, said flanges being of corrugated board, and a flexible sheet of paper enveloping said core periphery.

10. A reel as claimed in claim 5, said honeycomb core flexible sheets being of paper material, said core having sides, flanges concentric with said core secured to said core sides, said flanges being of corrugated board, and a flexible sheet of paper enveloping said core periphery.

* * * * *